United States Patent [19]

Sebelist et al.

[11] Patent Number: 4,635,542

[45] Date of Patent: Jan. 13, 1987

[54] METHOD OF COMPRESSING AND STRAPPING ARTICLES

[75] Inventors: Norman C. Sebelist, Coatesville; Edward N. Fulton, Exton, both of Pa.

[73] Assignees: Cyklop International; Emil Hoffman, both of Fed. Rep. of Germany

[21] Appl. No.: 700,471

[22] Filed: Feb. 11, 1985

Related U.S. Application Data

[63] Continuation-in-part of Ser. No. 547,425, Oct. 13, 1983, abandoned.

[51] Int. Cl.[4] ..... B30B 15/14; B65B 13/20

[52] U.S. Cl. ..... 100/3; 100/32; 100/50; 100/99

[58] Field of Search ..... 100/3, 32, 50, 99

[56] References Cited

U.S. PATENT DOCUMENTS 2,929,608 3/1960 Zippel ..... 100/32 X 3,916,778 11/1975 Van Dourn ..... 100/50 X 3,939,762 2/1976 Smitherman ..... 100/3

*Primary Examiner*—Billy J. Wilhite

*Attorney, Agent, or Firm*—Lipton & Familgio

[57] ABSTRACT

A method and apparatus in which a predetermined load is placed upon an article prior to securing the article being strapped such as to hold said article together. The apparatus disclosed provides a means for controlling the drive force used to apply pressure to said article before strapping. In the preferred embodiment, an electric motor is mounted on a frame which allows the motor's displacement, relative to the frame of the strapping mechanism caused by the reactional torque of the motor applying force to the article prior to strapping. The measurement of the displacement of the motor relative to the stationary frame is monitored by an electrical apparatus, the output of which is compared to a predetermined value of desired force, thereby switching operation of said motor upon reaching the predetermined force.

10 Claims, 7 Drawing Figures

METHOD OF COMPRESSING AND STRAPPING ARTICLES

This application is a continuation-in-part of an earlier filed U.S. patent application Ser. No. 547,425 filed on Oct. 13, 1983, now abandoned, entitled Improved Strapping Apparatus.

SUMMARY OF THE INVENTION

The present invention relates to a method of strapping and binding of various materials and articles which are to be shipped or otherwise transported. The prior art consists of automatic strapping machines such as that described in U.S. Pat. No. 4,254,703 which discloses various means to automatically and sequentially wrap, tension, and eventually bind the article under consideration.

In the strapping process, it is desirable, in many situations, to apply compression to the articles to be strapped, prior to the strapping process taking place. For example, a stack of unexpanded, corrugated cardboard boxes for shipping, or articles of lumber being strapped for shipping, particular plywood sheets, lend themselves well to this type of processing prior to shipping. It is desirable to apply compression to the stack so that they may be more firmly bound and strapped for shipping. The present methods for accomplishing this consist of apparatus which have a platen-like surface driven in a fashion such as to apply downward pressure on a stack of articles which are placed in position on a conveyor system.

In the preferred embodiment of the invention disclosed herein, an improved method of applying compression to the articles to be strapped is disclosed. It is desirable that the compression used in processing various articles be limited to a predetermined value prior to the strapping process. Heretofore, only crude and inaccurate methods of limiting the compression have been utilized. The present invention provides an accurate method to measure the compression used and to limit that compression to a user determinable amount, prior to the strapping process, as one integrated step.

It is the object of the present invention to provide an improved apparatus for applying strapping to various articles by applying a predetermined resettable value of compression to an article while it is being strapped and being secured.

It is further an object of the present invention to provide an improved method for applying an accurately measured, predetermined compression load on an article to be strapped while said article is being secured by strapping.

BRIEF DESCRIPTION OF THE DRAWINGS

Other objects and advantages of the invention will become apparent upon reading the following detailed description and upon reference to the drawings in which like numerals refer to like parts and in which.

DETAILED DESCRIPTION OF THE PREFERRED EMBODIMENT

Figure 1:
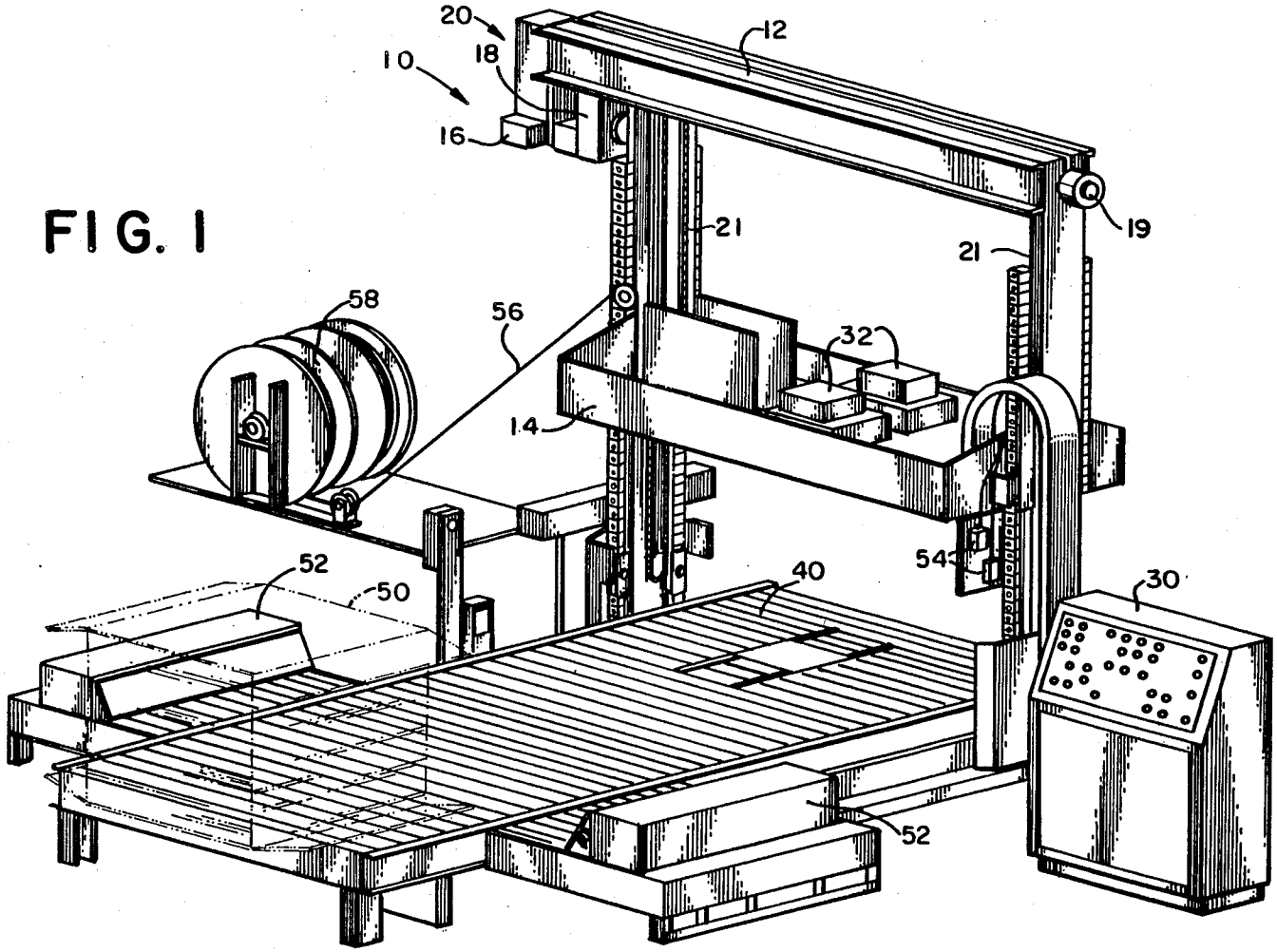
FIG. 1 is a perspective view of the entire invention in operation.

Turning now to FIG. 1 of the drawings, the entire invention perspective view can be seen as it appears in operation. The present invention utilizes various main components which will be described in detail below. The improved strapping mechanism 10 consists mainly of frame 12, platen 14, motor drive assembly 20, control panel housing 30, and a linear measurement transducer 22, shown in FIG. 3. Considering FIG. 1, a group of articles 50 to be strapped proceed down conveyor system 40 to be placed in a position below platen 14 so that they may be compressed. Traveling in a direction on the conveyor towards the strapper 10, guides 52 are propelled to an inward direction such as to assure that the articles 50 are not approaching the strapper 10 in askewed position. It is desirable to have the stack of articles to be strapped presented under platen 14 in a square position so that strapping 56 may be placed about the articles across the flat side of such articles. Guides 52 are reversed at the appropriate time and articles 50 continue towards strapper 10 for processing. As articles 50 approach frame 12, photocells 54 measure the height of articles 50 so that platen 14 may be adjusted to be about six inches above the top of the pile of articles 50 to be compressed. Articles 50 are stopped when the conveyor system brings them squarely under platen 14. At this point, platen 14 is lowered by motor assembly 20, more particularly shown in FIG. 2.

FIG. 1 shows the chain drive 21 which attaches motor assembly 20 to platen 14 such as to cause it to travel along frame 12 in the downward position thereby compressing the pile of articles 50 placed there. Chain Drive 21 is driven by motor 20 through gear box 18. Gear box 18 drives shaft 19 which transmits torque through to chain drives 21, which ride in slots contained in frame 12 as shown in FIG. 1. Drive 21 is fixed to platen 14 and provides for this movement of platen 14 relative to frame 12.

It will be appreciated that drive shaft 19 is operatively connected to both chain drives 21, located in both of the vertical support members of frame 12. As shown in FIG. 1, drive shaft 19 traverses the length of frame 12 such as to drive the chain drive 21 which is located in the vertical member of 12 farthest from the end supporting motor assembly 20. When platen 14 contacts articles 50, it is desirable to place a predetermined load which is selected on the control panel of control housing 30 shown in FIG. 1. It will be appreciated that many articles to be strapped, including stacks of plywood, unassembled cardboard boxes for shipping, textiles, printed materials and the like have a considerable amount of dead space or unexpelled air within the various articles in a given stack. Therefore, to assure tight bundling during a strapping processes, it will be appreciated that a fixed downward pressure will secure the articles by compressing each individual item in the pile together. In this way, any strap or fastening device circling the pile can be secured in a tighter position, thereby assuring a secure fit when the pressure is removed.

When the downward pressure asserted by platen 14 reaches a predetermined amount, strapping 56 is placed around articles 50 through strapping heads 32, such that strap 56 completely surrounds articles 50 and are thereby tightened and sealed, as more particularly described in U.S. Pat. No. 4,327,744. The methods for applying strapping automatically about an article are illustrated in U.S. Pat. No. 4,254,703, which is incorporated herein by reference. After application of strapping about articles 50, platen 14 is raised such as to allow clearance for articles 50 to continue on the conveyor, thereby allowing another pile of articles to be processed as indicated above.

Figure 2:
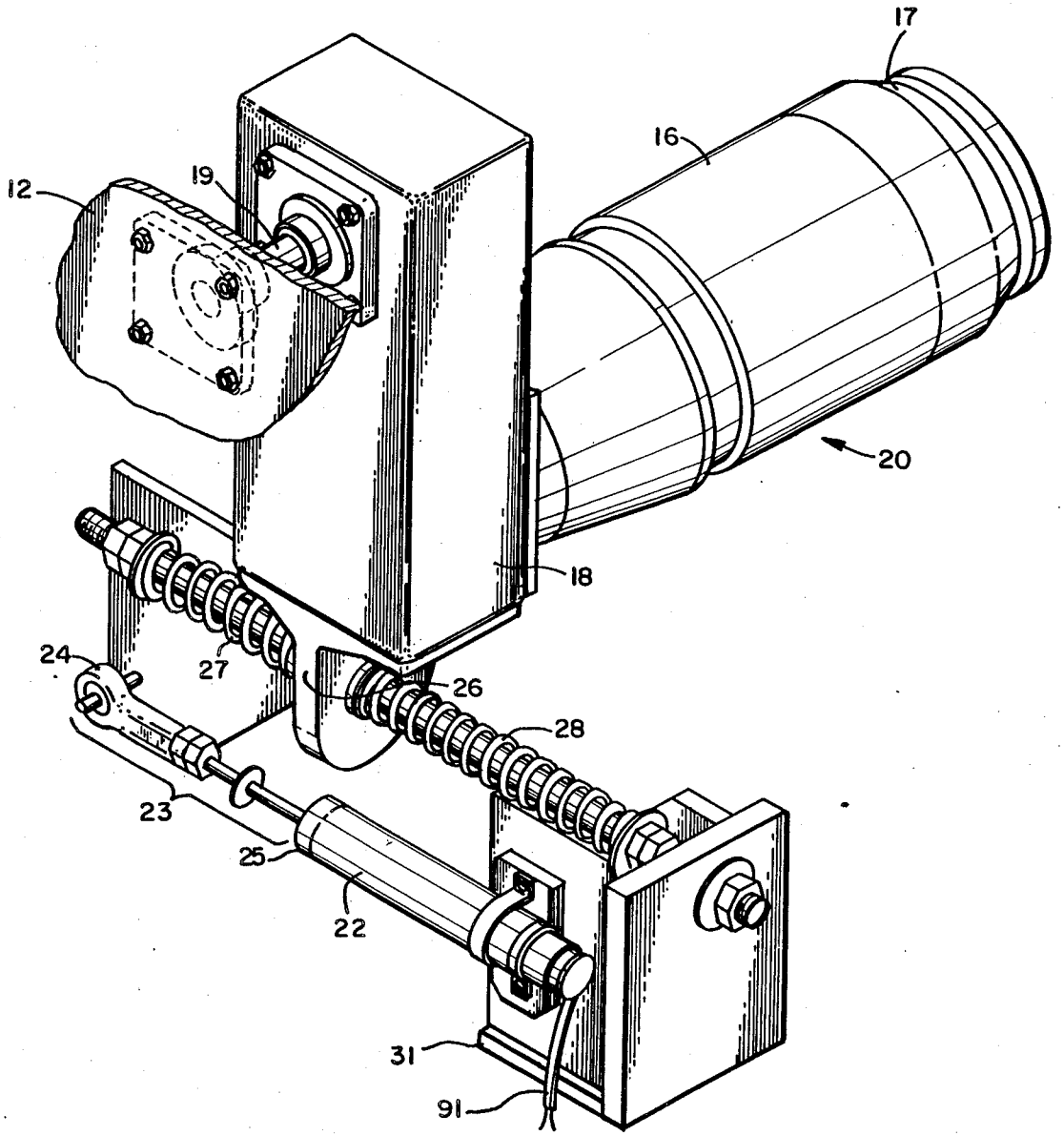
FIG. 2 is a perspective view of the motor assembly, including the motor drive, brake and gear box.

Turning now to FIG. 2, motor drive assembly 20 is more particularly illustrated. Motor 16, in the preferred embodiment, is a synchronous electric motor of approximately three (3) horsepower and turning approximately 1,750 revolutions per minute. Motor 16 is connected to drive assembly 20 only at the gear box 18 as shown. Motor 16 is connected to gear box 18, which is an 85 to 1 drive reduction, and drive shaft 19. Shaft 19 is connected to frame 12 with a thrust bearing to support gear box 18. Shaft 19 extends on the opposite side of gear box 18 such as to drive a chain mechanism which drives a shaft extending across the entire length of frame 12, as illustrated in detail in FIG. 1.

It will be appreciated that it is desirable to measure, in some fashion, the amount of pressure being exerted by platen 14 while it is pressing downward on a pile of articles 50. The present invention incorporates a unique system which provides for a closed loop feedback method which switches the motor drive unit on and off when platen 14 exerts a preset pressure. In order to sense this pressure, it will be appreciated that it is possible to measure the stress or force being exerted in the drive mechanism present in drive assembly 20. When platen 14 is raised or lowered without encountering an object in its path, it will require a relatively predictable amount of force or drive from motor assembly 20. The amplitude of the force will be relatively constant as platen 14 travels unobstructed. However, upon contacting the pile of articles 50, the drive requirement to continue to advance platen 14 will increase sharply.

Figure 3:
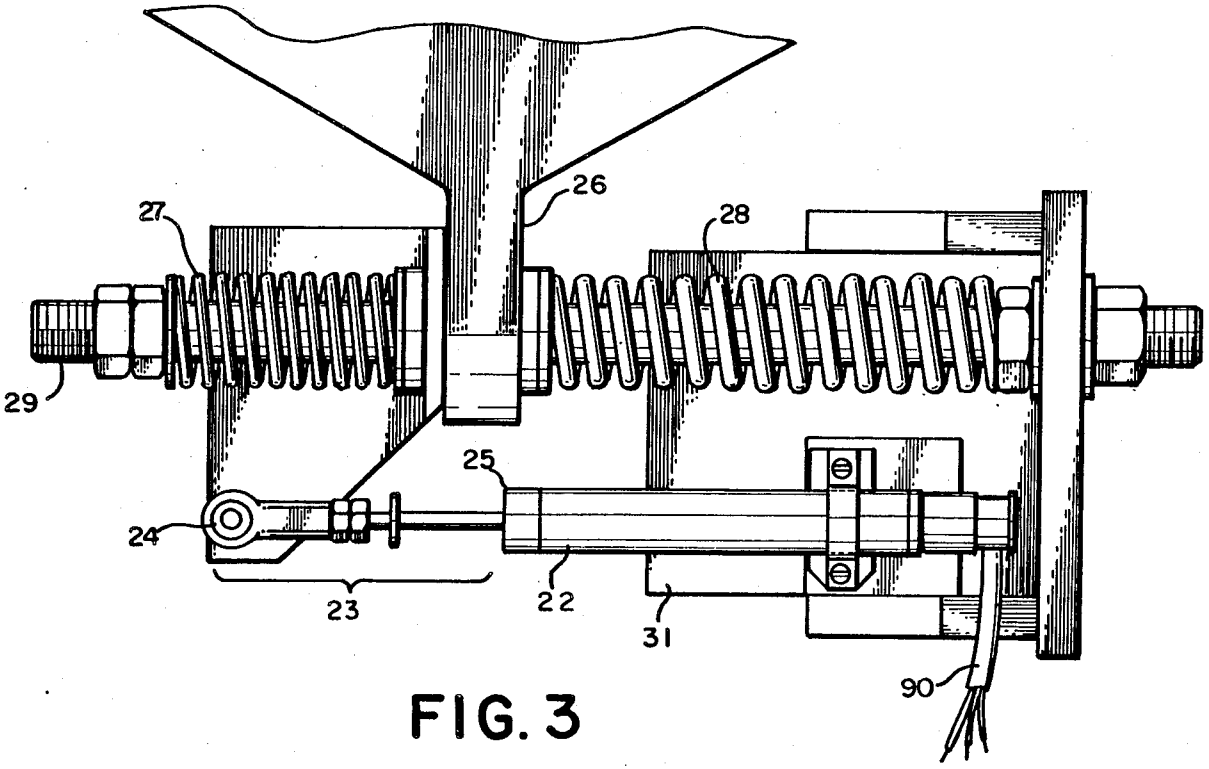
FIG. 3 is a view of the motor anti-torque spring shaft with the variable resistor linear movement transducer shown.

One method of measuring the force being applied to drive assembly 20 is to measure the torque required by motor 16 at a given point. The torque output of motor 16 will increase in proportion to the amount of pressure being exerted by platen 4 at any one moment in time. Flange 26, as shown in FIGS. 2 and 3, is an integral part of gear box 18. It provides a reference point in that this flange exhibits substantially linear displacement in proportion to the amount of torque being exerted at any one time by motor 16. On close observation of FIG. 3, which is a direct view of the perspective view shown in FIG. 2, flange 26 will be displaced in one direction or another depending on the direction of motor 16. In the downward direction, in the view shown, spring 28 will be compressed as platen 14 engages a load such as to cause additional torque output from motor 16. As spring 28 is compressed along spring shaft 29, movable transducer end 24, by virtue of its connection as shown to flange 26, moves proportionally to the movement of 26. Stated in other terms, the distance between end 24 and sleeve shaft end 25, represented by the distance marked 23, is proportional to the amount of displacement exhibited by flange 26. The displacement of Flange 26 is proportional to the torque output in any one moment being exhibited by motor 16, and thereby is an accurate indication of the torque output of motor 16. It will be appreciated that flange 26 does not travel in a direction which is parallel to the axis of spring shaft 29. As is understandable from observing FIG. 2, the movement of flange 26 will actually describe the arc of curve, in that flange 26 is rotating about a point described by the axis of gear box drive shaft 19, as shown in FIG. 2. However, in the preferred embodiment there is enough clearance between spring shaft 29 and the opening in flange 26 in which spring shaft 29 protrudes, that binding between contact of the flange 26 with shaft 29 is avoided. The actual displacement of flange 26, and hence transducer end 24 is less than an inch or so in actual operation of the present invention. For this reason, a problem does not arise with the contact of flange 26 with the spring shaft 29 in that a displacement of several inches would be required for binding between the two components to occur.

Transducer 22 is fixed to flange 31, which is ultimately connected to the main frame 12 of the present invention. Transducer 22 is a variable resistor. It will be appreciated that the resistance, as measured across transducer 22, is proportional or otherwise varies in accordance with the distance 23, which is exhibited in response to the movement of flange 26.

It will be appreciated that the mechanical dynamics present and operating on the drive assembly 20 create the movement of flange 26. The torque required to drive shaft 19, (illustrated in FIG. 2 and shown in detail in various other figures), increases as platen 14 makes contact with the articles 50. There will be an equal and opposite reaction of torque tending to twist the assembly 20 in the opposite direction of the transmitted torque through shaft 19. It is this equal and opposite reaction to the torque which causes a tendency of the assembly 20 to rotate, thereby causing flange 26 to move in one direction or the other depending on the direction of the torque. It should be pointed out that motor 16 is not fixed to the frame any other location than that indicated so as to allow this free movement in reaction to its driving torque. In the preferred embodiment, the actual movement of flange 26 need only be one or two inches at most. This observed displacement is sufficient to provide adequate movement of transducer 22 so that the varying resistance created thereby, as measured across control line 91 shown in FIG. 2, may be used to control the switching circuit for motor 16.

Figure 4:
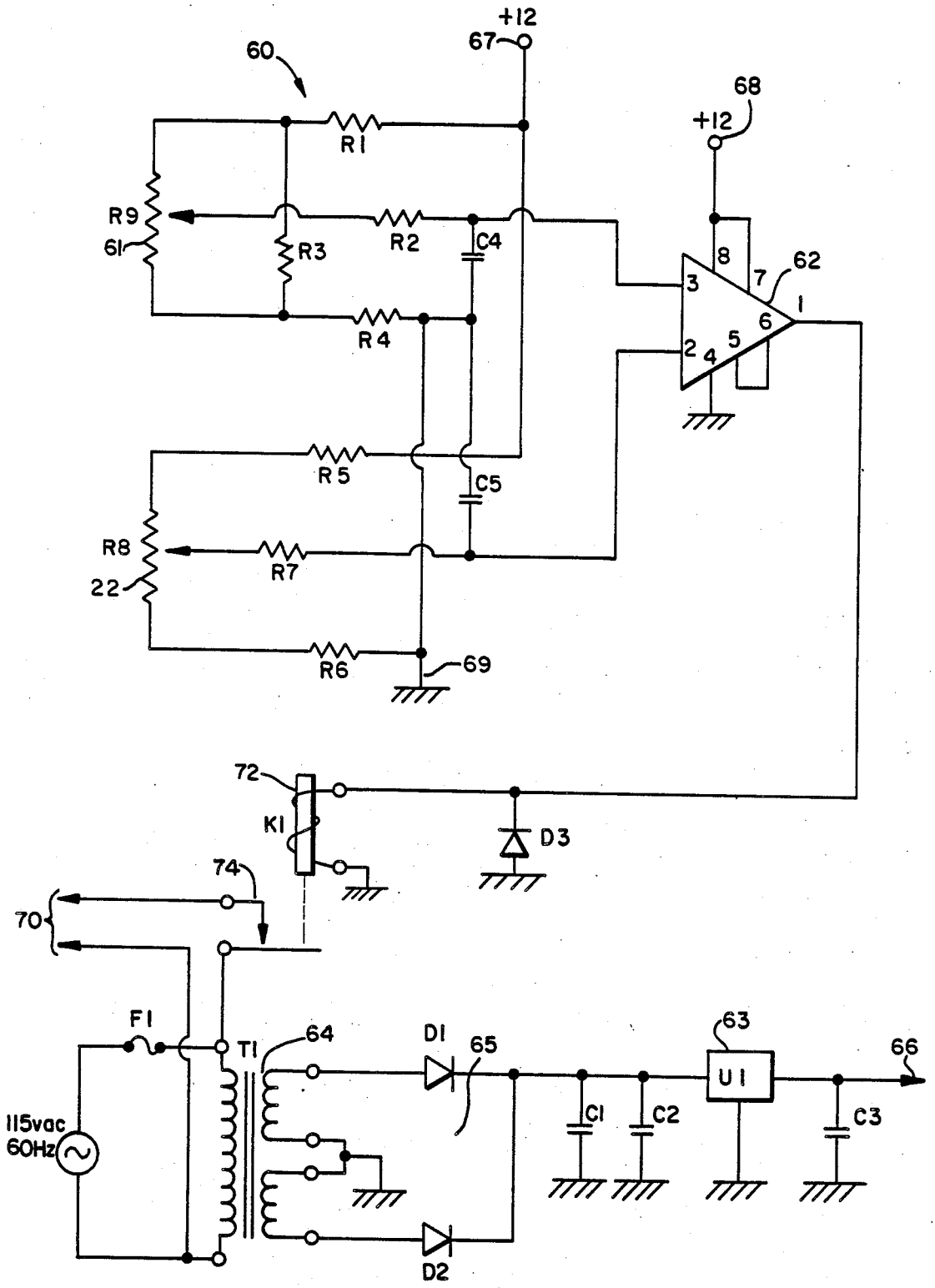
FIG. 4 is an electrical schematic diagram of the load sensing circuit utilized in the preferred embodiment.

Turning now to FIG. 4, the electrical circuit used in the preferred embodiment is shown in detail. Electrical transducer 22 is shown at the left hand portion of the drawing with lines 90 attached thereto. There is an adjustable potentiometer 61 which is used to adjust the sensitivity of the system and allow for varying loads to be applied. The adjustable potentiometer 61, or pot 61, is contained on a control assembly 30 and is user adjustable, calibrated such that the user may adjust the limit for the amount of compression of articles 50 desired. FIG. 4 shows the components used in the preferred embodiment to effect the desired result of controlling the primary power, in the present case 115 volts, which is used to drive motor 16.

It will be appreciated by anyone skilled in the art that FIG. 4 describes a controller circuit that will start and stop motor 16 by comparing the value of the resistance exhibited by the linear transducer 22 to that preset by the adjustable pot 61 so indicated. The circuit shown in FIG. 4, generally referred to as a comparitor circuit, simply compares one preset resistance value to that of any unknown variable value, and produces an output when the variable unknown resistance reaches or exceeds a predetermined value.

Considering FIG. 4 in detail, transducer 22 as shown in the diagram as R-8, being a resistor of a value of 3 kilohms. R 8, shown as 22 on the diagram, is a potentometer or variable resistor with three terminals as shown. At the top of R-8 leads through resistor R-5 to a 12 volt source, introduced at terminal 67. The bottom terminal of R-8 is grounded through the chassis at ground terminal 69. The center movable terminal of R-8 or wiper, is connected through R-7 to terminal 2 of comparitor circuit 62.

In a similar fashion, adjustable potentometer 61, or R-9 as shown in FIG. 4, has three terminals. The top terminal of R-9 is connected to 12 volt terminal 67 through R-1, as shown on the diagram. The bottom terminal of R-9 is connected through the chassis ground at terminal 69 as shown. The center terminal or wiper, of R-9 is connected to terminal 3 of comparitor 62 through resistor R-2. In summary, resistor R-9 and resistor R-8 each present a particular voltage value to terminal 3 and terminal 2 of comparitor 62, denoted in the diagram also as U-2. The output of the center wiper of R-9 and R-8 have a capacitor, C-4 and C-5, respectively, which is used to bypass any extraneous AC component to ground through terminal 69. It will be appreciated that any voltage in the present circuit should lack an AC component due to the nature of the circuit itself. Occasionally however, the electric environment in a warehouse or industrial setting causes electromagnetic fields, commonly referred to as noise, which can be picked up by long leads and transmission lines. Further, such noise could also be introduced through the primary power source for the circuit. Capacitor C-4 and C-5 assure filtering to ground of any such extraneous components. It is also possible to further avoid the pick-up of such extraneous AC components by using shielded cables for any length of run required in the present circuit. Specifically, transducer 22 is located at a considerable distance from the rest of the circuit since this transducer is located near the motor assembly 20. The remainder of the circuit 60 is located behind the control panel 30.

Turning now to comparitor 62, this comparitor is a commonly found integrated circuit, denoted as U-2 on the diagram. The comparitor circuit compares the value of a particular voltage presented at two of its terminals. When one of the values exceeds or is reduced to a value lower than that present at the other terminal, the output of said comparitor either goes on or off, or varies between two fixed values which are preset, depending upon the particular design of the component and the need in its application.

In the preferred embodiment, relay 72, depicted also as K1 in FIG. 4, is powered upon output voltage from comparitor 62. when the coil in relay 72 is activated by the comparitor output, relay 72 is caused to activate, thereby closing contacts on switch 74. The closure of switch 74 causes the 115 volt AC primary power to appear across terminal 70 which is connected to an additional relay 75, depicted as K2 in FIG. 5.

Figure 5:
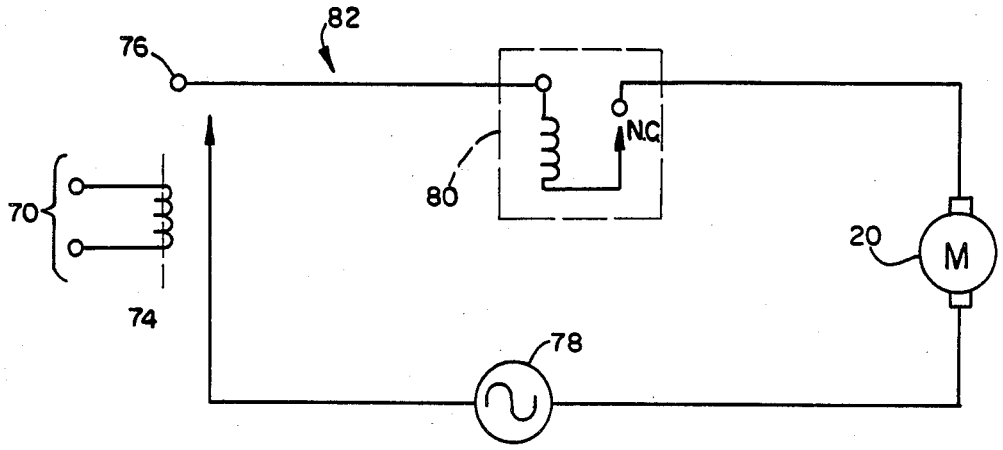
FIG. 5 is an electrical schematic diagram of a compression sensing circuit.

When AC primary power appears and opens K2 in FIG. 5, relay contact 76, which are normally closed, are caused to open thereby disrupting AC primary power 78 which would supply motor 20. In the preferred embodiment, relay 75 is of the time delay type which is well known to those skilled in the art. A time delay relay is a relay which remains in a given position, either opened or closed, for a preset period of time after the removal or application of its primary power. In the present invention, relay 75 remains energized for one-half of a second after the removal of voltage across terminal 70. In this way, the given displacement of flange 26 is obtained, motor 20 continues to operate for one half of a second thereby assuring that the platen 14 is snuggly driven down against the lode 50 which is being compressed. Upon the opening of relay 75 hence contact 76, primary power to the motor 20 is disrupted and the platen, after the half second delay indicated above, ceases to operate. Motor 20 has a built-in braking device which locks the position of the motor at all times that primary power is not applied across motor 20.

Figure 6:
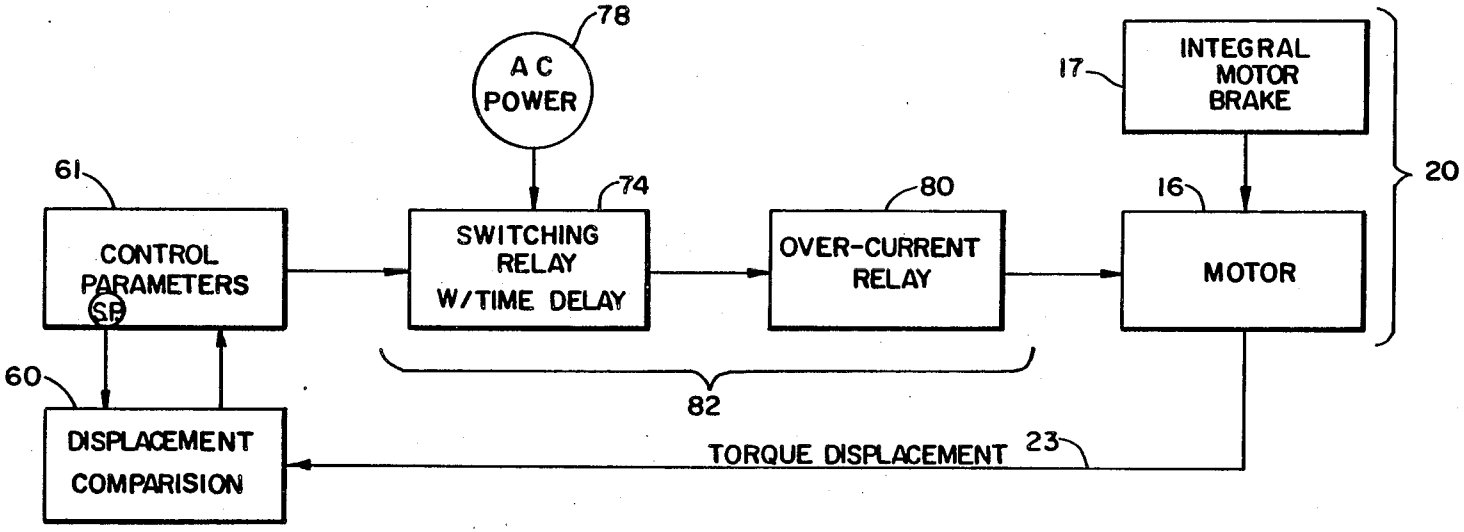
FIG. 6 is a block diagram of the entire motor control system for the platen drive of the present invention.

Over current relay 80 is also employed in the preferred embodiment. The purpose of an over current relay is likewise well known to those skilled in the art and the construction of the same is common knowledge. Over current relay is designed such as to measure current flowing through its measuring circuit and operate when a predetermined current is exceeded. Relay 80 is preset to a certain value of current to indicate a stalled condition in motor 20 or some other problem which may occur such as a jamming of the driving mechanism for platen 14. Over all, over current relay 80 is a safety device to avoid a fire or a burnout of motor 20 in a stalled condition which would occur if the force against platen 14 exceeded a value which motor 20 was capable of supplying, given any torque multiplication through the transmission of the torque of motor 20 through gear box 18 and the corresponding gears which are in the motor assembly 20 and used to drive platen 14 along the track in frame 12. Under normal conditions, absent some particular problem or failure of a component, over current relay 80 would not be engaged. The over current relay serves as an emergency override should there be a failure in the motor torque sensing circuit as described above also. In summary, the present combination allows for actual measurement of the amount of normal force being applied by platen 14 to the articles 50 while taking into account transient resistances which may cause momentary displacement of flange 26 and still provides for a safety measure to remove power from the platent drive should an over current condition exist. Referring now to FIG. 6, a system block diagram for the load sensing circuit is shown. The block diagram in FIG. 6 shows, essentially, the switching logic utilized in the present invention. Beginning with motor 16, torque displacement of the motor assembly 20 is compared to set point desired dialed in on control panel 30. Resistor 61 is depicted on the present diagram as a set point shown as a control parameter which would be located on the front panel 30. Set point is compared with the actual torque displacement 23 at any moment in time. As the torque displacement meets or exceeds the set point value, switching relay 75 with its inherent time delay as earlier described is powered and, after a set time delay, being 0.5 seconds in the preferred embodiment, AC power 78 is removed from motor 16, causing the integral motor brake 17 to engage thereby fixing the position of the platen 14 until the strapping process is complete.

Figure 7:
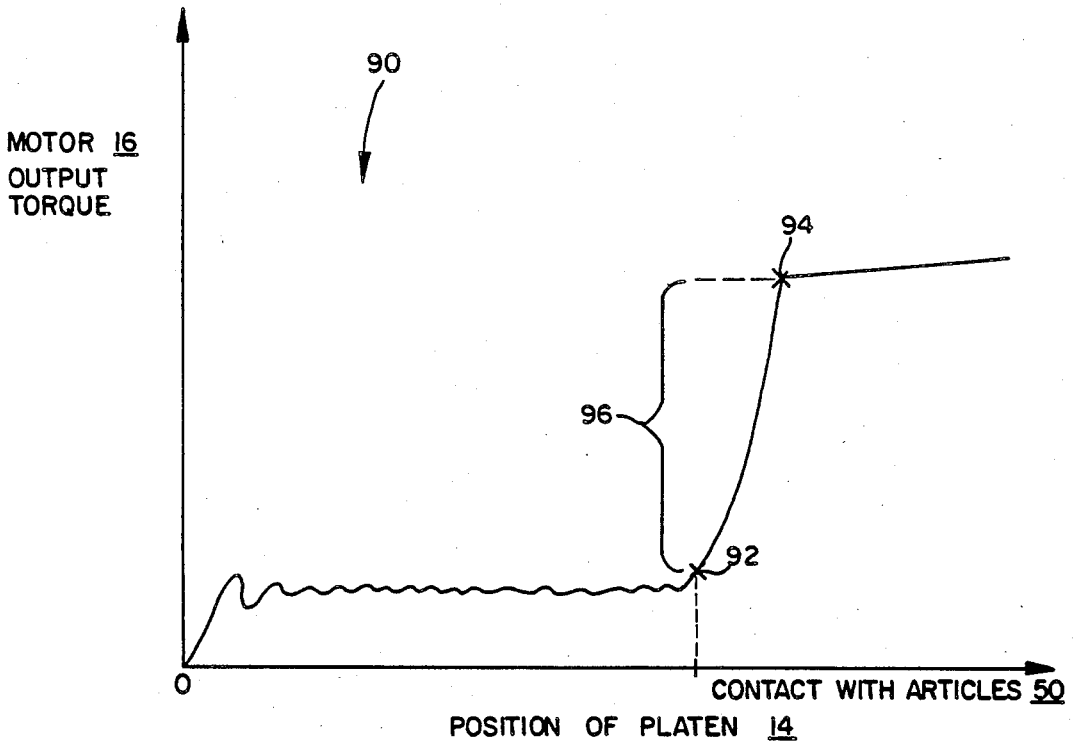
FIG. 7 is a graph showing the motor output torque on the vertical axis and the position of the platen on the horizontal axis.

Turning now to FIG. 7, a graph of motor output torque, represented by the Y axis, is shown in relation to the position of platen 14, represented by the X axis on FIG. 7. As can be seen by the graph, the output torque of motor 16 is not a fixed value, given to the normal environment which would be encountered in driving the chain drive 21 and the inefficiencies and inherent inconsistencies in gear boxes such as gear box 18 of the present invention. Torque varies slightly over time as the position of platen 14 lowers prior to contact articles 50. Upon contact with articles 50, platen 14 encounters significant reactionary force causing the torque output of motor 16 to increase suddenly, shown at point 92 on FIG. 7. Point 94 represents the point at which the motor 16 would stall. The purpose of over current relay 80 shown in the present disclosure is to prevent this situation from occurring, in the event that there was a failure in one of the other circuit components disabling the torque displacement sensing circuit which is disclosed herein. It is contemplated that the set point, selected by resistor 61, would be such as to select the force which would be represented by the curve depicted at 96 on FIG. 7.

While the invention has been described in connection with a preferred embodiment, it will be understood that it is not intended to limit the invention to that embodiment. On the contrary, it is intended to cover all alternatives, modifications, and equivalents as may be included within the spirit and scope of the invention as defined by the appended claims.

What is claimed is:

1. A method for applying strapping and securing articles to be secured together in which said articles: are compressed to a predetermined, measured compression force by pressing down upon them with a platen, the height of which is adjusted relative to an article to be strapped, by means by photocells that measure the height of the articles to be strapped;

said article being held at said predetermined compression force while strapping about the articles is automatically applied and tensioned to a particular force; and then the compression force is removed after completion of the strapping of said articles.

2. The method of claim 1 which further comprises driving the platen toward the article to be compressed by means by a motor assembly.

3. The method of claim 2 wherein the compression that is to be applied by the platen is set at a predetermined value prior to the strapping process.

4. The method of claim 3 further comprising stopping and starting the motor assembly that drives the platen by means of a controller circuit.

5. The method of claim 4 wherein the controller circuit compares a present resistance value with an unknown value and produces an output when the variable unknown resistance reaches or exceeds a predetermined value.

6. The method of claim 5 further comprising incorporating a closed loop feedback method in the controller circuit mechanism so as to switch the motor assembly on and off at a preset pressure.

7. The method of claim 6 further comprising driving the motor assembly by means of a chain drive which receives and transmits torque output from the motor assembly.

8. The method of claim 7 further comprising measuring the torque output from the motor assembly by sensing the displacement of a flange with a transducer, which is a variable resister, fixed to it.

9. The method of claim 8 further comprising using a conveyer belt system to horizontally move objects to be compressed to a proper position under the compression platen.

10. The method of claim 9, further comprising tensioning the strapping to be applied to articles prior to removal of the compression force.

* * * * *